United States Patent [19]

Wynn

[11] 4,197,776

[45] Apr. 15, 1980

[54] LOCATION APPARATUS

[76] Inventor: Gordon W. Wynn, The Glebe, Holton-cum Beckering, Lincoln Lincolnshire, England

[21] Appl. No.: 820,455

[22] Filed: Aug. 1, 1977

Related U.S. Application Data

[60] Division of Ser. No. 584,289, Jun. 6, 1975, Pat. No. 4,041,824, which is a continuation of Ser. No. 174,423, Aug. 24, 1971, abandoned.

[51] Int. Cl.[2] ..... B27G 5/00

[52] U.S. Cl. ..... 83/765; 83/762; 269/87.2; 83/767

[58] Field of Search ..... 83/761, 762, 763, 764, 83/765, 766, 767; 269/87.2

[56] References Cited

U.S. PATENT DOCUMENTS

| | | | |
|---|---|---|---|
| 151,222 | 5/1874 | Hough | 83/765 |
| 565,652 | 8/1896 | Walter et al. | 83/765 |
| 1,013,010 | 12/1911 | Graham | 83/762 |
| 3,028,888 | 4/1962 | Chapin et al. | 83/761 |
| 3,171,453 | 3/1965 | Brownrigg | 83/762 |

FOREIGN PATENT DOCUMENTS

| | | | |
|---|---|---|---|
| 904254 | 8/1962 | United Kingdom | 83/761 |

*Primary Examiner*—Donald R. Schran
*Attorney, Agent, or Firm*—Elliot A. Lackenbach

[57] ABSTRACT

Saw guide apparatus for longitudinal or near longitudinal saw cuts in an elongate workpiece has a base from which at least one saw guide column projects upwards. The base and said column provide respective horizontal and vertical bounding faces which are coplanar so as to define a vertical support plane against which the elongate workpiece can be placed to depend below the base. Location means are provided to set the position of the workpiece transversely to a saw guide plane defined by said guide columns so that the position of the saw cut in the workpiece can be controlled correspondingly.

6 Claims, 14 Drawing Figures

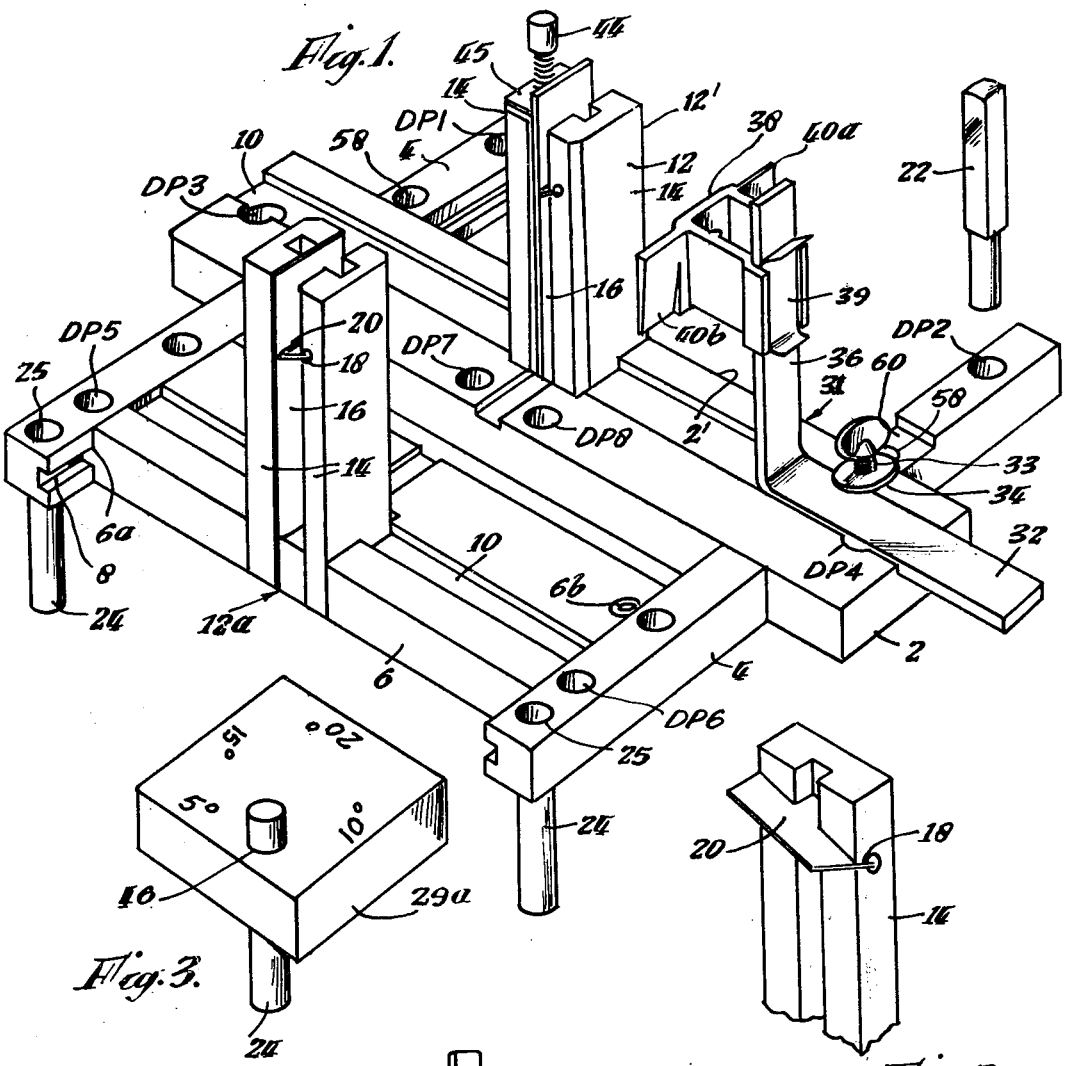
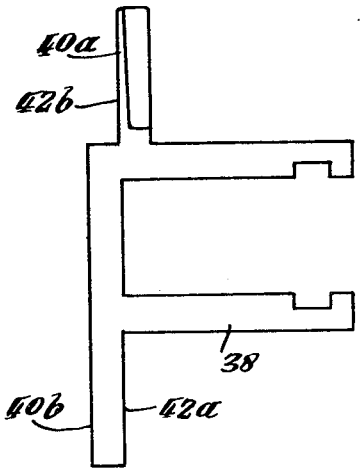
Fig. 5.

LOCATION APPARATUS

This application is a divisional application of my application Ser. No. 584,289, filed 6th June 1975 now U.S. Pat. No. 4,041,824 which was a continuation of prior copending application Ser. No. 174,423 filed 24 Aug. 1971 abandoned.

BACKGROUND OF THE INVENTION

This invention relates to apparatus for the location of a workpiece in order to perform sawing operations upon the workpiece.

Such location apparatus is known in a wide variety of forms comprising a base surface on which the workpiece is laid, with means for locating it in a predetermined position with respect to saw guides that extend above that surface. This form of apparatus cannot, however, be usefully employed to make longitudinal or near longitudinal cuts in an elongate workpiece, when with the workpiece located on the base the region of the required saw cut will be placed far above the saw guides.

Other location apparatus is known with similar location arrangements but which is rested on the workpiece itself, and the workpiece is in turn held steady in a vise while being sawn. Even this form of apparatus can often not be usefully employed for longitudinal cuts as aforesaid: for example, the steadiness of the apparatus during sawing is then dependent on the workpiece being of an extremely rigid nature, while the working height using a conventional bench-mounted vise to hold the workpiece may be too high for control and comfort.

SUMMARY OF THE INVENTION

According to the present invention there is provided location apparatus for use in making a saw cut in a workpiece, comprising a support structure, means defining a saw guide plane comprising at least one saw guide member projecting from the support structure to extend upwardly therefrom, the or a said member being located with a face coplanar with a face of the apparatus extending transversely thereto, whereby said mutually transverse faces define an engagement plane for the workpiece to locate it in a position in which it depends below the support structure, transverse position location means being mounted on said support structure to control the position of the workpiece in a direction transverse to the saw guide plane.

Preferably, said transverse position location means comprises a device having a first elongated element extending transversely the saw guide plane and a second elongated element extending parallel the saw guide plane, guide means on the workpiece location means engaging said first element in a manner permitting movement of said location means device towards and away from the saw guide plane for adjustment of the position of said second element of the location means device in a direction transverse the saw guide plane, and means releasably securing said location means device to the workpiece location means whereby said second element is fixed at selected spacing from the saw guide plane to be employed in determining the workpiece position in said transverse direction.

By way of examples only, embodiments of the invention will now be described in greater detail with reference to the accompanying drawings.

BRIEF DESCRIPTION OF THE DRAWINGS

FIG. 1 is a perspective view of a first location apparatus or jig according to the invention, FIG. 2 is a detail view of a part of a saw guide column of the jig of FIG. 1, FIG. 3 shows a spacer block for use with the jig of FIG. 1, FIGS. 4(a) to (f) are diagrammatic plan views showing the jig of FIG. 1 being used for different operations, FIG. 5 is a detail plan view of the selector head of the jig of FIG. 1.

DESCRIPTION OF THE PREFERRED EMBODIMENTS

Figure 4A:
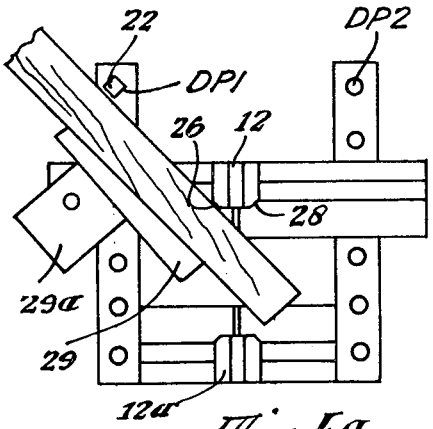

Referring more particularly to FIG. 1 of the drawings, the jig shown there comprises a base or support frame, e.g. of hardwood, that includes a main cross-member 2 to which two transverse connecting members 4 are secured, and a supplementary cross-member 6 having tongues **6*a* seating in grooves 8 in the connecting members 4 so that the member 6 can be slid towards and away from the member 2 and, if required, can be removed from the illustrated position between the forward ends of the connecting members and reinserted between the rear ends of these members to lie behind the main cross-member 2. A friction element 6*b* acts to keep the member 6 in any setting in which it has been placed. Although such adjustability of the member 6** increases the range of usefulness of the jig, it is not necessary for many operations and it is therefore possible for it to be fixed in position instead. These faces of the members which are to be used to engage and locate a workpiece may be roughened or given an antislip coating or cover if required.

The two cross-members 2, 6 each have a longitudinal groove 10 and centrally of its length and at said groove, each member has a vertical guide column 12, **12*a* respectively which may be permanently or detachably secured in place. The columns act as co-planar guides for a saw blade and each comprises a pair of parallel limbs 14 one of which is faced with a wear-resistant plate 16, on which a side face of the saw blade can be located. Seated in a groove 18 that is obliquely inclined when viewed from the front, there is a strip 20, e.g. of nylon, that acts as a spring urging the saw blade against the location face formed by the plate 16**. The choice of a suitable plastics material for the plate has the effect that movement of the saw blade in the guide hones the saw teeth to a certain extent.

At accurately spaced positions on the jig is a series of receiving holes DP1 to DP8 in which there can be inserted square-headed location pins 22 or dowel pins 24. These pins, in conjunction with the guide columns themselves when required, act as engagement members to locate the workpiece in the required sawing position relative to the saw guide plane defined by the columns. To act as a stop locating the jig against the edge of a work bench, further dowel pins can project downwards from two of the holes, or from other such holes such as are shown at 25 in FIG. 1, to bear against the edge of the bench.

By way of example, FIG. 4 illustrates a number of modes of operation of the jig of FIG. 1.

In the arrangement shown in FIG. 4*a*, an elongate workpiece is wedged against a pin 22 located in hole DP1 and against the guide column 12, it thus being held with its longitudinal axis at 45° to the saw guide plane for the cutting of a mitre joint face.

For clamping a workpiece, a single wedge 29 or a pair of wedges may be inserted in the space between the workpiece and a dowel pin, depending upon the width of the space to be filled. The wedges may be used in conjunction with other packing members, such as the spacer block 29*a* shown in FIG. 4*a* located on a dowel pin in the hole DP3.

Figure 4B:
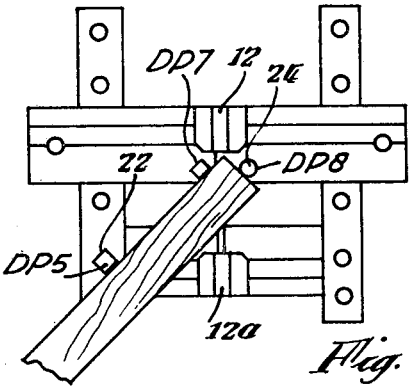

If a mitre with half lap joint is wanted, to allow the mitreed face to be cut in the appropriate relation to the squared end face of the workpiece, pins in holes DP7 and 5 are used, as shown in FIG. 4*b* and a further pin in the hole DP8 bears on the squared end face of the workpiece. In order to give better support to the workpiece in this second instance, however, where the workpiece does not bear on a guide column, it is possible to provide a shouldered pin (not shown) one end of which seats in a receiving hole, e.g. DP7 in this instance, and the other, smaller diameter end of which seats in a bore in the wedge 29 close to its narrow end face. The arrangement is such that the narrow end face of the wedge forms a location for the workpiece and the bottom face of the wedge is itself adequately supported by the jig frame to prevent any tilting of the location face.

Figure 4C:
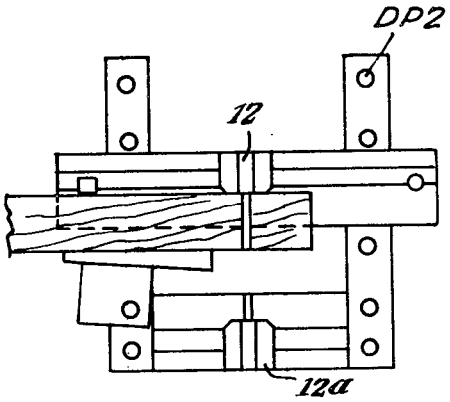

FIG. 4*c* shows an elongate workpiece being cut at 90° to its axis, the guide column 12 and a location pin 22 in the hole DP3 forming a location plane for the workpiece, which is held in position by a spacer block 29*a* and wedge 29 as already described.

Figure 4D:
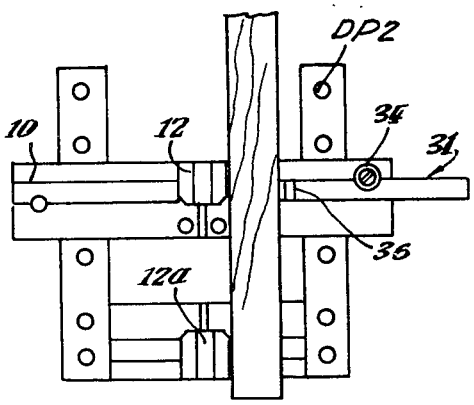

When cutting halved joints and tenons, in which the width of the material to be removed from a workpiece is dependent upon the width of the mating part of the joint, transverse location means are employed for determining the saw cut position along the length of the workpiece. Such means are shown in FIGS. 1 and 5 and comprise a right-angled gauge bar 31 slidably mounted in the groove 10 of the cross-member 2 by its lower limb 32, a locking thumbscrew 33 and washer 34 being retained by a tapped hole in the cross-member 2 and clamping the gauge bar when screwed down. Referring to FIG. 4*d* the initial step in setting the gauge bar involves sliding the gauge bar forwards until its upper limb 36 bears lightly on the member inserted between it and the guide column 12 and clamping the gauge bar in that position.

A selector head 38 can then be slid onto the limb 36 on which it is frictionally gripped by the action of a spring 39 e.g. of nylon. The head 38 is provided with opposed blades 40*a*, 40*b*, each of wedge form but tapering in opposite directions and having vertical faces 42*a*, 42*b* in a common plane which is spaced from the adjacent face of the vertical limb 36 by a distance equal to that between the location face formed by the plate 16 and the opposite side face 12′ of the guide column 12. The alternative blades 40*a* and 40*b* of the selector head 38 provide for the formation of a jointing recess in a workpiece, either intermediate the length of the workpiece when the width of the recess will include two saw kerfs, or, in contrast to this closed form of recess, an open recess at the end of the workpiece, when the recess width will include only one saw kerf.

Figure 4E:
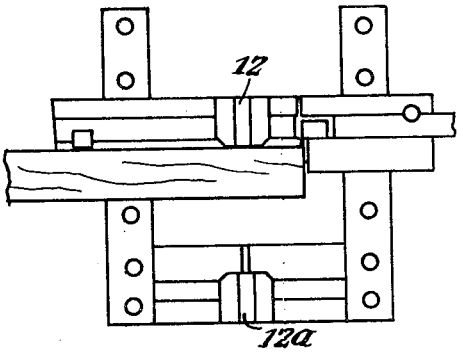
Figure 4F:
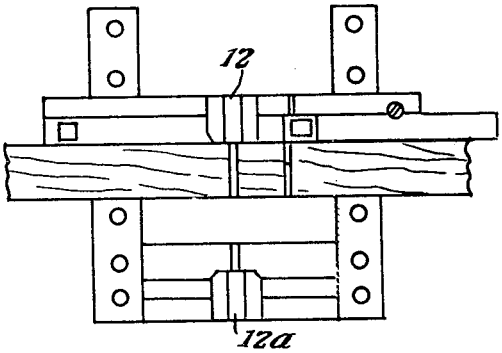

For an open recess or tongue, the selector head is slipped onto the clamped gauge bar with its blade 40*a* operative, as shown in FIG. 4*e*, and the workpiece is brought into abutment with the blade, it then being in position for a saw cut to be made at the saw guide plane to form the end face of the recess. For a closed recess, one of the end faces of the recess is first cut in the workpiece and then, with the selector head reversed so that its blade 40*b* is operative, as shown in FIG. 4*f*, the blade is slid into the first saw cut, and the workpiece will then be correctly positioned for the second end face to be sawn.

Instead of using a contacting selector head as described above, it is possible to locate a workpiece for similar saw-cutting operations by employing a sighting procedure using the gauge bar alone or with the selector head or other member secured to it and used as a non-contacting sighting element.

In order to control the depth of a saw cut in a workpiece, one or both guide columns can be provided with adjustable depth-stops. Such a device is shown in FIG. 1 in the form of a plastic-headed screw 44 extending vertically into a hole at the top of the column 12 and located at the required height by a nut 45 threaded onto it which rests on top of the column. The head of the screw is of a size that allows it to engage with the back or spine of a tenon saw as the saw cut proceeds, so limiting the cut depth to that set by the screw.

The spacer block 29*a* referred to above is intended to be used also to obtain an oblique setting for a workpiece relative to the saw guide plane. The block is shown square but can be of any polygonal form, and it has a hole 46 so located in it that the hole axis is at a different distance from each edge of the square or polygon. Thus by positioning the block by its hole on a dowel pin, for example at the location DP6, the block can be rotated to provide four alternative locating faces for a workpiece each of which will set the transverse axis of the workpiece at a different angle to the saw guide plane. The wedge or wedges 29 can also be used to provide particular angle settings, either alone or in conjunction with the spacer block, and for this purpose there are preferably at least two wedges with angles of 6° and 8° respectively. Wedges with these particular angles can be employed in the apparatus to cut dovetail joints. In some instances the wedge will have one face parallel to the member 2 and perpendicular to the plane of the frame formed by the members 2, 4, 6 and in other instances it will have one face parallel to the member 2 and the plane of the frame formed by the members 2, 4, 6. In the first case, the workpiece will have its axis set obliquely to the member 2 but in a plane parallel to the plane of the frame, while in the other case the workpiece axis will be oblique to the plane of the frame but will lie in a plane parallel to the member 2.

It will be appreciated that the spacer block can be used on pins at different positions and in conjunction with two such wedges to locate the workpiece at any one of a range of angles.

Figure 6:
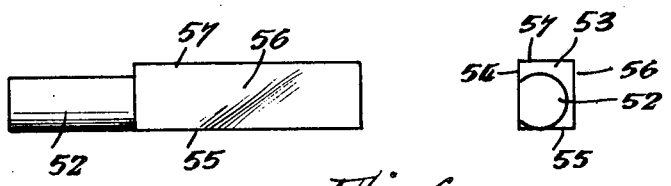
FIG. 6 shows side and plan views of a location pin for use with the jig of FIG. 1, FIGS. 7 and 8 are perspective views of modified forms of the jig of FIG. 1.

The location pins 22 have the form indicated in FIG. 6. The lower circular shank 52 is the same diameter as the dowel shank so that faces 54, 55, 56, 57 are at progressively greater distances from the shank axis, the face 55 being tangential to the circular shank. Preferably, the circular shank 52 is ground away or otherwise relieved so that it does not project beyond the face 54. These different settings may provide, for example, changes in the angle setting of a workpiece of $-\frac{1}{2}°$, 0°, $+\frac{1}{2}°$ and 1°. In this way, by selecting the face on which a workpiece is to bear, slight changes of setting can be obtained to compensate for tolerances in the alignment of the jig, for example, or to modify the setting obtainable by use of the spacer block and wedges, e.g. so as to obtain a $22\frac{1}{2}°$ miter angle for a regular 8-sided frame. If desired, the block 30 may be given a square hole to receive a location pin 22.

The apparatus may also be used to make saw cuts in a workpiece parallel or at small angles to the longitudinal axis of the workpiece, in which case the supplementary cross-member 6 is preferably inserted in the rear ends of the connecting members 4 and the jig is reversed so that dowel pins in the additional holes 58 act as bench stops. The workpiece can be inserted in the opening between the two cross-members and clamping means applied to these members to hold the workpiece firmly in position. It is to be noted that the rear face 12' of the column 12 is flush with the rear face 2' of its cross-member 2 so that the workpiece will then bear directly on the column.

It is possible to use the gauge bar 31 as a vertical guide by placing its limb 32 in a further slot 60 where it can be locked in position by the thumbscrew 33 since the washer 34 overlaps that further slot 60 also. The vertical limb 36 of the gauge bar can then be used as a bearing location for the workpiece and, in conjunction with the rear face of the column 12, it will set the workpiece square for a longitudinal saw cut to be made. Alternatively, the slot 10 in the cross-member 6 can be used for this purpose, the member 6 then preferably being fixed in position and the slot 10 extending across one connecting member 4. A blade of the selector head on the bar 30 would then project into the space in front of the member 6.

Figure 7:
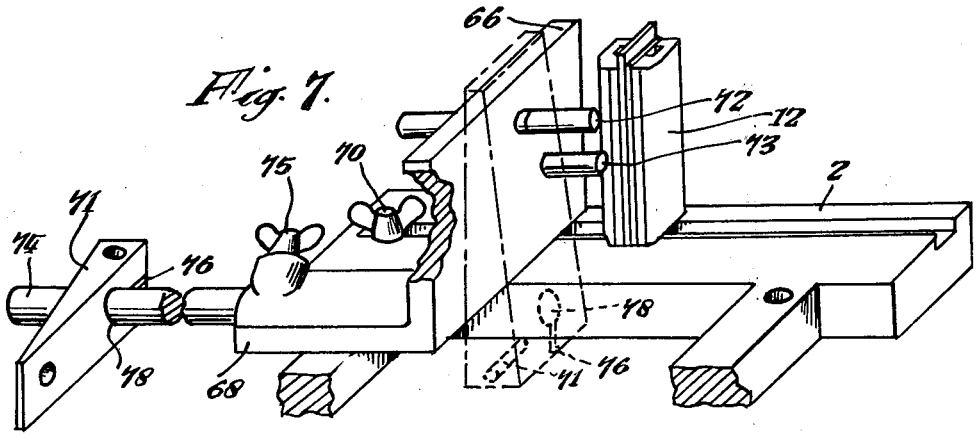

Longitudinal or near-longitudinal saw cuts can also be made using an alternative form of transverse location attachment such as is illustrated in FIG. 7 being used with a modified form of jig but which can with suitable modification of the jig in FIG. 1, be used there also.

Referring to FIG. 7, the attachment comprises a right-angled component having vertical and horizontal plates 66, 68 respectively. The attachment is slidable along the groove 10 in the cross-member 2 (or unillustrated cross-member 4) of the jig to which it can be locked by a locking nut 70 on a belt extending through an elongate slit in the plate 68 parallel to the groove 10. The workpiece is positioned in the opening to the front of the cross-member 2 to extend below the support frame with a longitudinal side face resting against the plate 66, the setting of the attachment determining the position of the workpiece relative to the saw guide plane. Advantageously the workpiece is held vertical by means of a clamp integral with the jig (e.g. the supplementary cross-member 6) or by a bench vice or, alternatively, where no such means is available, the jig can be so positioned to lock the workpiece between the jig and a work table.

In the production of dovetail joints, for example, where oblique cuts are required in the end face of a workpiece, the vertical attachment can be used in conjunction with one or more wedges 71 as shown in FIG. 7 to provide an appropriately inclined abutment face for the workpiece relative to the saw guide plane. The wedges and the vertical plate 66 may have holes for dowel pins to locate a wedge on the plate 66. In addition, these pins may also aid in the positioning of the workpiece for sawing, one pin 72 acting as a height stop member and another pin 73 determining the lateral position of the workpiece on the plate 66.

The attachment is provided with an elongate rod 74 of circular cross-section extending from and slidably mounted in the plate 68 and lockable thereto by a clamping nut 75. One or more wedges 71 may be slidably mounted on the rod 74 at different positions along the rod and at different angular positions relative to each other, the wedges each having a slot 76 to form jaws that can be drawn together to grip the rod where it passes through bore 78 of the wedge. Wedges so mounted on the rod can be used as stop-members for a workpiece positioned horizontally on the jig, a chosen wedge being brought into position by rotating the rod 74 until that wedge extends across the longitudinal projection of the workpiece and thus provides and end-stop for the workpiece. A further location for the workpiece is afforded by the side face of the horizontal plate 68. It is to be appreciated that the different features described for the wedges 71 can be provided together in common wedge members.

Figure 8:
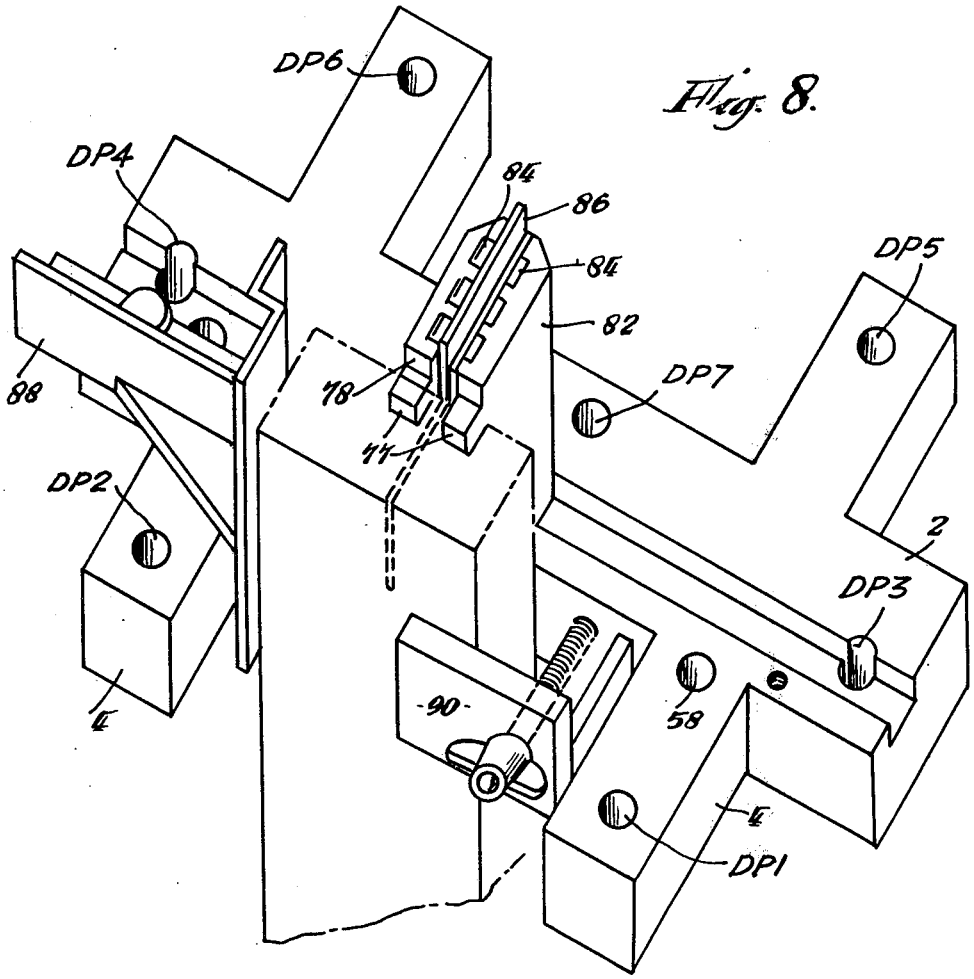

FIG. 8 illustrates a jig similar in many respects to the jig of FIG. 1 and corresponding parts are given the same reference numbers. It will be noted that in this construction there is only a single cross-member 2 carrying a single guide column 82 which now has a series of mounting springs 84 for the guide plates 86. Vertical stops 77 are provided on planar face 78 of the column 82, which face is protuberant of the cross-member 2 to form a vertical guide face for location of the workpiece. A second vertical guide face perpendicular to the face 78 is provided by a detachable abutment member 88 that is adjustably positionable along the cross-member 2. A screw clamp 90 holds the workpiece firmly in position in the opening provided for it to the front of the cross-member 2.

Figure 9:
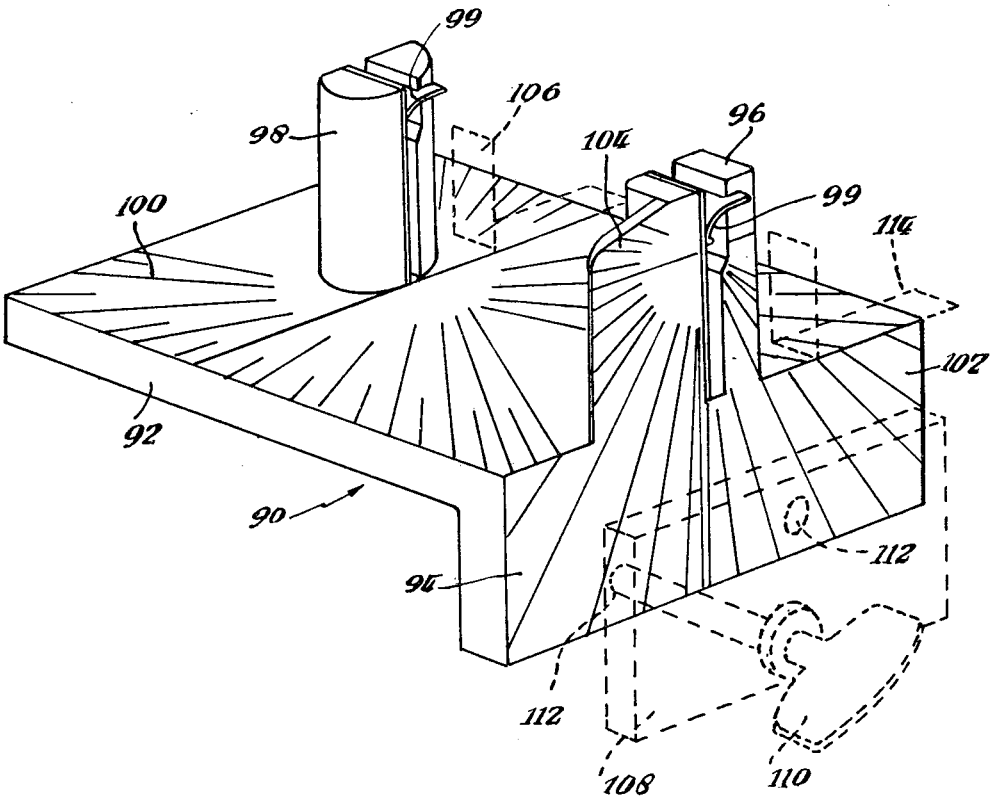
FIG. 9 shows a further form of location apparatus according to the invention.

FIG. 9 shows a further embodiment of the invention comprising a base in the form of an angle plate 90 which can be placed on the edge of a workbench (not shown) with a horizontal top plate 92 resting on the top surface of the bench and a vertical front plate 94 depending therefrom to bear against a front side face of the bench. Two saw guide columns 96, 98 are disposed one behind the other on the top face to define a saw guide plane analogously to the examples already described, the front column 96 being at the junction of the top and front faces of the base. Resilient strips 99 analogous to the strips 20 of earlier examples such as FIG. 1 urge a saw blade against wear-resistant plates in the guide columns and the present illustration shows how the resilient strips can be set in slots that run horizontally from front to rear.

On the top face of the plate 92 there is a series of lines 100 marked, etched, cut or otherwise formed, to radiate from the rear column 98, these defining guides for a workpiece (not shown) resting on the top face to locate a side face of the workpiece at predetermined angular positions relative to the saw guide plane. The lines are so placed that the side face of the workpiece aligned with them also bears against the rear column 98 for which purpose the forward face of the column has a curved profile. On the front face of the plate 94, a similar series of lines 102 are provided at different angular orientations to the vertical and the front column 96 has an extended side face 104 to carry some of this second series of lines.

Transverse location means analogous to those shown in the earlier figures may also be provided, on the top face at least, as indicated at 106. The apparatus may be arranged to allow the workpiece to be clamped against the face on which it bears, as indicated by the clamping plate 108 carried by a thumbscrew 110 engageable in alternative threaded bores 112, or it may be sufficient simply for the workpiece to be held in place by hand as it is sawn. FIG. 9 also shows a location means 114 disposed adjacent the front column for use in conjunction with an attachment such as the selector head 38 to locate a side face of a workpiece that bears against the front face of the plate 94 to make longitudinal saw cuts in the workpiece, analogously to the arrangement described above for this purpose using the gauge bar 30.

What is claimed is:

1. Location apparatus for use in making a saw cut in a workpiece comprising, in combination, a support structure providing a horizontal first support plane for the workpiece, saw guide means comprising at least one column-like saw guide member mounted on said support structure to extend upwardly from said horizontal first support plane, said saw guide means defining a vertical saw guide plane, said at least one column-like saw guide member being disposed at an edge of the support structure, a face of said support structure at said edge being located co-planar with an upwardly extending face of said column-like saw guide member and extending transversely thereto, whereby said faces together define a vertical second support plane for the workpiece to support it in a position in which its upper limit extends above said horizontal first support plane and its lower limit extends below the support structure, and transverse position location means mounted on said support structure for locating a workpiece supported at either of said support planes to control the position of the workpiece in a direction transverse said saw guide plane.

2. Location apparatus defined in claim 1 wherein said transverse position location means comprises a device having a first elongated element extending transversely the saw guide plane and a second elongated element extending parallel the saw guide plane, guide means on the support structure engaging said first element in a manner permitting movement of said device towards and away from the saw guide plane for adjustment of the position of said second element of the device in a direction transverse the saw guide plane, and means releasably securing said device to the support structure whereby said second element is fixed at selected spacing from the saw guide plane to be employed in determining the workpiece position in said transverse direction.

3. Location apparatus according to claim 1 wherein said transverse position location means comprises a location element and carrier means for disposing the element at said vertical second support plane whereby said element provides a contacting location for the workpiece.

4. Location apparatus according to claim 3 further comprising, means securing the carrier means adjustably to the support structure for varying the distance of said element from the saw guide plane, said element being removable from and replaceable on the carrier means while the carrier means is secured at a chosen distance from the saw guide plane.

5. Location apparatus according to claim 3 wherein said locating element comprises a blade for insertion in an existing saw-cut in the workpiece for said abutting location.

6. Location apparatus according to claim 1 further comprising clamping means for holding the workpiece in position against the support structure for sawing.

* * * * *